US009824627B2

(12) United States Patent
Kanda et al.

(10) Patent No.: US 9,824,627 B2
(45) Date of Patent: Nov. 21, 2017

(54) DISPLAY CIRCUIT AND DISPLAY APPARATUS

(71) Applicant: SAMSUNG DISPLAY CO., LTD., Yongin, Gyeonggi-Do (KR)

(72) Inventors: Eiji Kanda, Yokohama (JP); Masayuki Kumeta, Yokohama (JP); Ryo Ishii, Yokohama (JP)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 162 days.

(21) Appl. No.: 14/733,193

(22) Filed: Jun. 8, 2015

(65) Prior Publication Data

US 2015/0364085 A1 Dec. 17, 2015

(30) Foreign Application Priority Data

Jun. 12, 2014 (JP) ..... 2014-121464

(51) Int. Cl.
*G09G 3/3233* (2016.01)
*G09G 3/3241* (2016.01)

(52) U.S. Cl.
CPC ..... *G09G 3/3233* (2013.01); *G09G 3/3241* (2013.01); *G09G 2300/0465* (2013.01); *G09G 2300/0814* (2013.01); *G09G 2300/0819* (2013.01); *G09G 2300/0842* (2013.01); *G09G 2300/0861* (2013.01); *G09G 2310/08* (2013.01); *G09G 2320/043* (2013.01)

(58) Field of Classification Search
None
See application file for complete search history.

(56) References Cited

U.S. PATENT DOCUMENTS

| | | | | |
|---|---|---|---|---|
| 7,446,742 | B2 | 11/2008 | Noda et al. | |
| 9,666,131 | B2 * | 5/2017 | Chen | G09G 3/3258 |
| 2005/0093789 | A1 * | 5/2005 | Kim | G09G 3/3233 345/76 |
| 2005/0104818 | A1 * | 5/2005 | Kwak | G09G 3/3233 345/76 |
| 2005/0140604 | A1 * | 6/2005 | Shin | G09G 3/3233 345/76 |
| 2005/0168415 | A1 * | 8/2005 | Noda | G09G 3/3233 345/76 |
| 2005/0243076 | A1 * | 11/2005 | Kim | G09G 3/3233 345/204 |
| 2006/0145960 | A1 * | 7/2006 | Koga | G09G 3/3233 345/76 |
| 2007/0152934 | A1 * | 7/2007 | Maeda | G09G 3/3233 345/92 |

(Continued)

FOREIGN PATENT DOCUMENTS

| | | |
|---|---|---|
| EP | 1755104 B1 | 10/2010 |
| JP | 11-272233 | 10/1999 |

(Continued)

*Primary Examiner* — Nicholas Lee
*Assistant Examiner* — Benjamin Casarez
(74) *Attorney, Agent, or Firm* — Lee & Morse P.C.

(57) ABSTRACT

A display circuit includes a plurality of pixel circuits and a shared compensation transistor. Each pixel circuit includes a driving transistor to control light emission of a light emitter. The compensation transistor is to compensate the threshold voltages of the driving transistors of the pixel circuits.

20 Claims, 7 Drawing Sheets

(56) References Cited

U.S. PATENT DOCUMENTS

| | | | | |
|---|---|---|---|---|
| 2014/0049568 | A1* | 2/2014 | Qi | G09G 3/3258 345/690 |
| 2014/0160093 | A1* | 6/2014 | Chaji | G09G 3/3291 345/204 |
| 2015/0070252 | A1* | 3/2015 | Chen | G09G 3/3233 345/76 |

FOREIGN PATENT DOCUMENTS

| | | |
|---|---|---|
| JP | 2006-011470 | 1/2006 |
| JP | 2010-054788 | 3/2010 |

* cited by examiner

DISPLAY CIRCUIT AND DISPLAY APPARATUS

CROSS-REFERENCE TO RELATED APPLICATION

Japanese Patent Application No. 2014-121464, filed on Jun. 12, 2014, and entitled, "Display Circuit and Display Apparatus," is incorporated by reference herein in its entirety.

BACKGROUND

1. Field

One or more embodiments herein relate to a display circuit and display apparatus.

2. Description of the Related Art

An organic light emitting display generates images using a plurality of pixel circuits. Each pixel circuit includes a driving transistor that controls an amount of current to be supplied to a light emitting element. In an attempt to improve display quality, the pixel circuit may also include a transistor to compensate for variations in the threshold voltage of the driving transistor. The presence of the compensation transistor increases the size of the pixel circuits and also increases the data writing time, because compensation is performed in the data writing (or data programming) period.

SUMMARY

In accordance with one or more embodiments, a display circuit includes a plurality of pixel circuits, each pixel circuit including a driving transistor to control light emission of a light emitter; and a compensation transistor to compensate threshold voltages of the driving transistors of the pixel circuits.

Each pixel circuit may include a capacitive element, the driving transistor may include a first terminal connected to a power supply, a second terminal connected to a first terminal of the light emitter, and a control terminal, the driving transistor may connect the power supply and the first terminal of the light emitter based on a voltage applied to the control terminal to enable the light emitter to selectively emit light, the capacitive element may have a first end connected to the control terminal of the driving transistor and a second end connected to a common node of the pixel circuits, and one of the first or second terminals of the compensation transistor may be connected to the common node.

One of the pixel circuits may include the compensation transistor. The compensation transistor and the driving transistor may have a same polarity. The compensation transistor and the driving transistor may have substantially a same channel width and channel length. The compensation transistor and the driving transistor may have a same channel direction. The compensation transistor and the driving transistor may be oxide transistors.

The display circuit may include an initialization transistor to initialize a potential of the common node to allow the common node to have certain potential, and the pixel circuits share the initialization transistor. One of first or second terminals of the initialization transistor may be connected to the common node. Another one of the pixel circuits may include the initialization transistor. The pixel circuit including the compensation transistor may include the initialization transistor.

In accordance with one or more other embodiments, a display apparatus includes a display circuit including a plurality of pixel circuits, each pixel circuit including a driving transistor to control light emission of a light emitter and a compensation transistor to compensate for a threshold voltage of the driving transistor of the pixel circuits, wherein the pixel circuits share the compensation transistor.

In accordance with one or more other embodiments, a circuit includes a first pixel circuit; a second pixel circuit; and a transistor to compensate threshold voltages of driving transistors in the first pixel circuit and the second pixel circuit. The first pixel circuit may include the transistor. The first pixel circuit may be coupled to the transistor. The first and second pixel circuits may have at least two of a same polarity, substantially a same size, a same channel direction, or are oxide transistors. The size may include channel width and channel length.

The first and second pixel circuits may be connected to a first scan line, and the transistor may be connected to a second scan line different from the first scan line. The circuit may include an initialization transistor shared by the first and second pixel circuits. The transistor and the initialization transistor may output signals along a same signal line.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
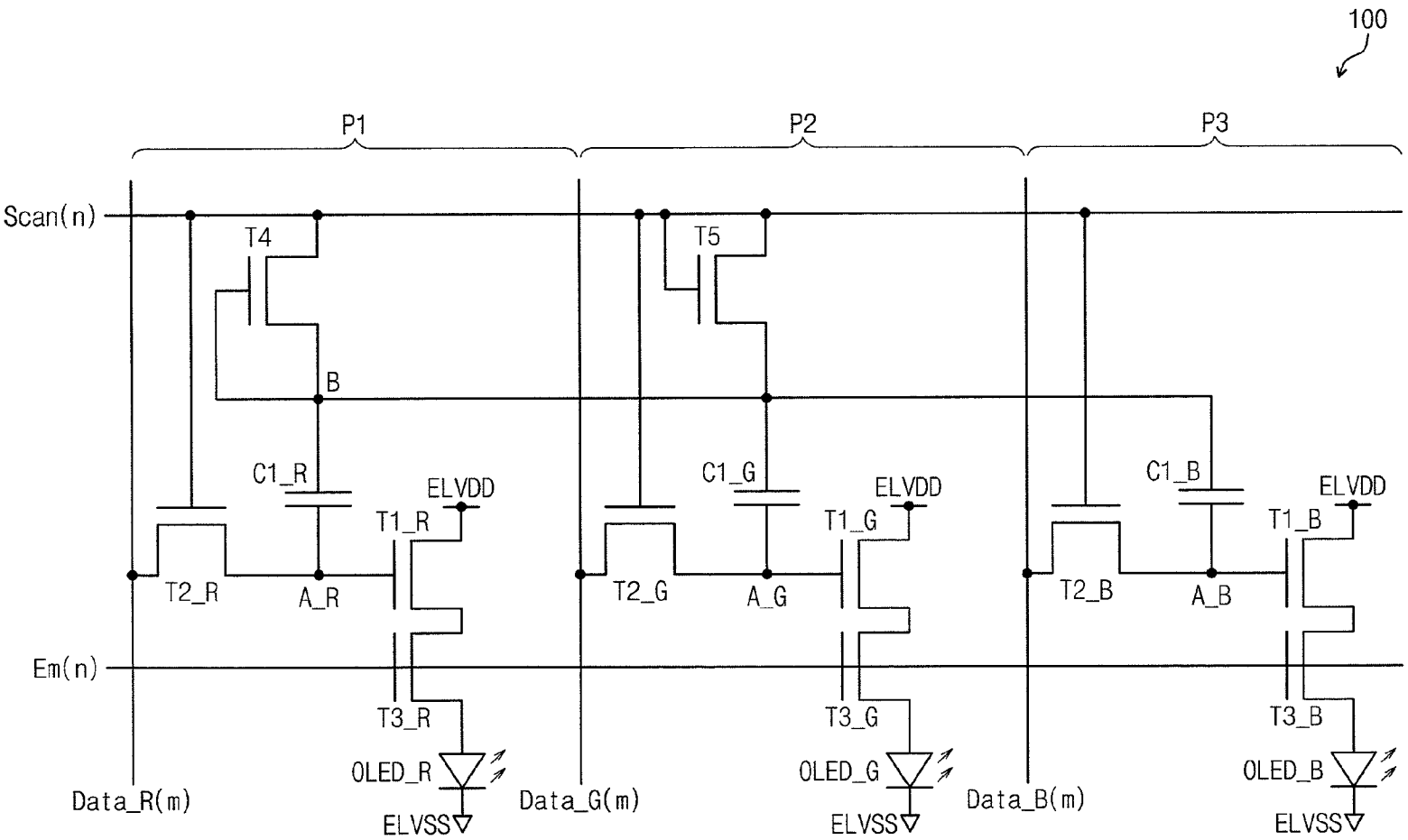
FIG. 1 illustrates an embodiment of a display circuit.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

In accordance with one or more embodiments, a display circuit includes a plurality of pixel circuits. Each pixel circuit includes a light emitting element that emits light based on current controlled by a driving transistor. The light emitting element may be, for example, an organic electroluminescence element or inorganic electroluminescence element. In one or more embodiments below, an organic EL element is described as the light emitting element for illustrative purposes only.

Also, in one or more embodiments, a compensation transistor for performing threshold voltage compensation is shared by multiple pixel circuits. The compensation transistor may be included in any one of the pixel circuits that share the compensation transistor. Thus, the number of compensation transistors may be fewer than the number of pixel circuits. Accordingly, the total number of elements (transistors) per pixel circuit, and indeed in the display circuit, may be reduced.

Also, in accordance with one or more embodiments, the display circuit may compensate for the threshold voltage of driving transistors using a simpler design and thus may prove to be efficient, cost effective, and more suitable for implementing high resolution displays.

Also, in accordance with one or more embodiments, compensation for the threshold voltage of the driving transistor of each pixel circuit may be performed separately from a data writing operation or period and the data writing time may be reduced. Also, an efficient time for compensating the threshold voltage of the driving transistor may be secured. As a result, display non-uniformity may be reduced or prevented when an image is displayed on a screen.

FIG. 1 illustrates an embodiment of a display circuit 100 which includes a plurality of pixel circuits P1, P2, and P3. The pixel circuit P1 includes a red-light emitting element OLED_R. The pixel circuit P2 includes a green-light emitting element OLED_G. The pixel circuit P3 includes a blue-light emitting element OLED_B. The pixel circuits P1 to P3 share a compensation transistor T4. In another embodiment, the display circuit 100 may include at least two pixel circuits that share a compensation transistor.

The pixel circuit P1 includes the lighting emitting element OLED_R, a driving transistor T1_R, a sampling transistor T2_R, a capacitive element C1_R. and a light emitting control transistor T3_R. The pixel circuit P2 includes the lighting emitting element OLED_G, a driving transistor T1_G, a sampling transistor T2_G, a capacitive element C1_G, and a light emitting control transistor T3_G. The pixel circuit P3 includes the lighting emitting element OLED_B, a driving transistor T1_B, a sampling transistor T2_B, a capacitive element C1_B, and a light emitting control transistor T3_B.

Data lines Data_R(m), Data_G(m), and Data_B(m) cross a scan line Scan(n) and a light emitting control line Em(n). The scan line Scan(n) and the light emitting control line Em(n) extend in parallel to each other. The parameters m and n are integers larger than 0. The pixel circuits P1 to P3 are connected to the data lines Data_R(m), Data_G(m), and Data_B(m), the scan line Scan(n), and light emitting control line Em(n).

A data signal is supplied from a data driver to the data lines Data_R(m), Data_G(m), and Data_B(m). A scan signal is supplied from a scan driver to the scan line Scan(n). A light emission control signal is supplied from a light emitting control driver to the light emission control signal line Em(n).

The pixel circuit P1 also includes compensation transistor T4. The compensation transistor T4 is connected to the common node B of the pixel circuits P1 to P3. Since the compensation transistor T4 is connected to the common node B, the compensation transistor T4 is shared by the pixel circuits P1 to P3.

The pixel circuit P2 further includes an initialization transistor T5 that initializes the potential of the common node B so that the common node has certain potential. The initialization transistor T5 is connected to the common node B. Since the initialization transistor T5 is connected to the common node B, the initialization transistor T5 is shared by the pixel circuits P1 to P3.

As illustrated in FIG. 1, the initialization transistor T5 is in the pixel circuit P2 but not in the other pixel circuits P1 and P3. Also, the initialization transistor T5 is in a pixel circuit different from the pixel circuit (e.g., P1) which includes the compensation transistor T4. Thus, the number of transistors in each pixel circuit may be reduced. In another embodiment, the compensation transistor T4 and the initialization transistor T5 may be in a same pixel circuit.

For convenience, each pixel circuit P1, P2 or P3 may be collectively referred to as a pixel circuit P, the light emitting elements OLED_R, OLED_G, or OLED_B may be collectively referred to as a light emitting element OLED, the driving transistor T1_R, T1_G, or T1_B may be collectively referred to as a driving transistor T1, the capacitive element C1_R, C1_G, or C1_B of each pixel circuit P1, P2, or P3 may be collectively referred to as a capacitive element C1, the sampling transistor T2_R, T2_G, or T2_B may be collectively referred to as a sampling transistor T2, the light emitting control transistors T3_R, T3_G, or T3_B may be collectively referred to as light emitting control transistor T3, and the data lines Data_R(m), Data_G(m), and Data_B (m) connected to the pixel circuits P1 to P3, respectively, may be collectively referred to as a data line Data(m).

Each transistor may be a field-effect transistor such as a thin film transistor (TFT) or metal-oxide-semiconductor field effect transistor (MOSFET). For illustrative purposes, the transistor in FIG. 1 is illustrated as an N channel type TFT but may be a P channel type in another embodiment. Also, the transistor may be, for example, an amorphous silicon transistor, low temperature poly silicon transistor or oxide transistor.

The driving transistor T1 supplies current to the anode of the light emitting element OLED based on a data signal receiving from the data line Data(m). The driving transistor T1 includes a first terminal (e.g., drain terminal) connected to a power supply ELVDD, a second terminal (e.g., source terminal) connected to a first terminal (e.g., anode) of the light emitting element OLED, and a gate (control terminal).

The driving transistor T1 connects the power supply ELVDD connected to the first terminal and the first terminal of the light emitting element OLED connected to the second terminal based on a voltage applied to the gate of the driving transistor T1. The voltage applied to the gate of the driving transistor T1 is provided from the data line Data(m) to enable the light emitting element OLED to selectively emit light.

The light emitting control transistor T3 is connected between the second terminal of the driving transistor T1 and the first terminal of the light emitting element OLED in the display circuit in FIG. 1. Therefore, light emission of the light emitting element OLED in the display circuit 100 is controlled based on the level (e.g., voltage level) of a light emission control signal applied to the gate (control terminal) of the light emitting control transistor T3 through the light emitting control line Em(n).

Since the driving transistor T1 enables the light emitting element OLED to selectively emit light, the pixel circuit P of the display circuit 100 may not include the light emitting control transistor T3 in this embodiment.

The capacitive element C1 has one end connected to the gate of the driving transistor T1 and the other end connected to the common node B. The capacitive element C1 maintains the potential of the gate of the driving transistor T1. The pixel circuit P may maintain data corresponding to a data signal from the data line Data(m) by the capacitive element C1. The capacitive element C1 may be, for example, a capacitor that has certain electrostatic capacity and/or may be realized by parasitic capacitance.

The sampling transistor T2 has a gate connected to the scan line Scan(n). The sampling transistor T2 selectively applies, to the gate of the driving transistor T1, a data signal from the data line Data(m) based on a scan signal from the scan line Scan(n).

The light emitting control transistor T3 includes a first terminal (e.g., drain terminal) connected to the second terminal of the driving transistor T1, a second terminal (e.g., source terminal) connected to the first terminal of the light emitting element OLED, and a gate (control terminal). The gate of the light emitting control transistor T3 is connected to the light emitting control line Em(n). A light emission control signal is applied to the gate of the light emitting control transistor T3 through the light emitting control line Em(n).

The light emitting control transistor T3 plays a role in selectively connecting the light emitting element OLED and the driving transistor T1, based on the voltage level of a light emission control signal applied to the gate of the light emitting control transistor T3. Also, the light emission of the light emitting element OLED may be controlled by the voltage level of a light emission control signal applied to the gate of the light emitting control transistor T3, as described above.

The compensation transistor T4 of the pixel circuit P1 plays a role in compensating for the threshold voltage of the driving transistor T1 of the pixel circuit P. Any one of the first or second terminals (drain or source terminals) of the compensation transistor T4 is connected to the common node B, and the other terminal is connected to the scan line Scan(n). Also, the gate (control terminal) of the compensation transistor T4 is connected to the common node B.

The compensation transistor T4 may be a transistor having the same polarity (channel type) as the driving transistor T1, as shown in FIG. 1. For example, the compensation transistor T4 may be an N channel type transistor. Also, the compensation transistor T4 and the driving transistor T1 may have the same channel width and channel length. For example, the compensation transistor T4 and the driving transistor T1 may have the same shape and size.

In one embodiment, the channel directions of the compensation transistor T4 and driving transistor T1 may be the same. Also, the compensation transistor T4 and the driving transistor T1 may be oxide transistors that include oxide semiconductors.

The compensation transistor T4 and the driving transistor T1 may be configured to satisfy two or more of the following: same polarity, same channel width and channel length, same channel direction, and oxide transistors.

The initialization transistor T5 of the pixel circuit P2 plays a role in initializing the potential of the common node B so that the common node has certain potential. Any one of the first or second terminals (e.g., drain or source terminals) of the initialization transistor T5 is connected to the common node B, and the other terminal is connected to the scan line Scan(n). Also, the gate (control terminal) of the initialization transistor T5 is connected to the scan line Scan(n).

In this embodiment, the compensation transistor T4 is shared by the plurality of pixel circuits P1, P2, and P3. Also, in another embodiment, each pixel circuit may have a different structure, e.g., a different number of transistors and/or capacitors. For example, the polarities of all transistors of the pixel circuit P in FIG. 1 may be an N channel type or P channel type transistors. Also, in another embodiment, the polarities of the compensation transistor T4 and the driving transistor T1 may have the same and/or the polarities of other transistors may be opposite to those of the compensation transistor T4 and the driving transistor T1.

Also, the pixel circuit P1 includes the compensation transistor T4 in FIG. 1. However, as previously indicated, the pixel circuit P2 or the pixel circuit P3 may include the compensation transistor T4 in another embodiment. In another embodiment, the compensation transistor T4 may be shared by and be external (e.g., and coupled) to the pixel circuits P1 to P3, and the compensation transistor T4 may be connected to the common node B. Also, in FIG. 1, the pixel circuit P1 includes the compensation transistor T4. However, in another embodiment, the pixel circuit P2 or the pixel circuit P3 may include the compensation transistor T4. In another embodiment, the initialization transistor T5 may be external (e.g., and coupled) to the pixel circuits P1 to P3, and the initialization transistor T5 may be connected to the common node B.

In another embodiment, the display circuit 100 may not include the initialization transistor T5. In another embodiment, the display circuit 100 may be configured so that the pixel circuit P does not include the light emitting control transistor T3. In another embodiment, the display circuit 100 may not include the sampling transistor T2.

In FIG. 1, the anode of the light emitting element OLED connected to the second terminal of the driving transistor T1. In another embodiment, the cathode of the light emitting element OLED may be connected to the second terminal of the driving transistor T1. When the cathode of the light emitting element OLED is connected to the second terminal of the driving transistor T1, the cathode of the light emitting element OLED corresponds to the first terminal of the light emitting element OLED.

Figure 2:
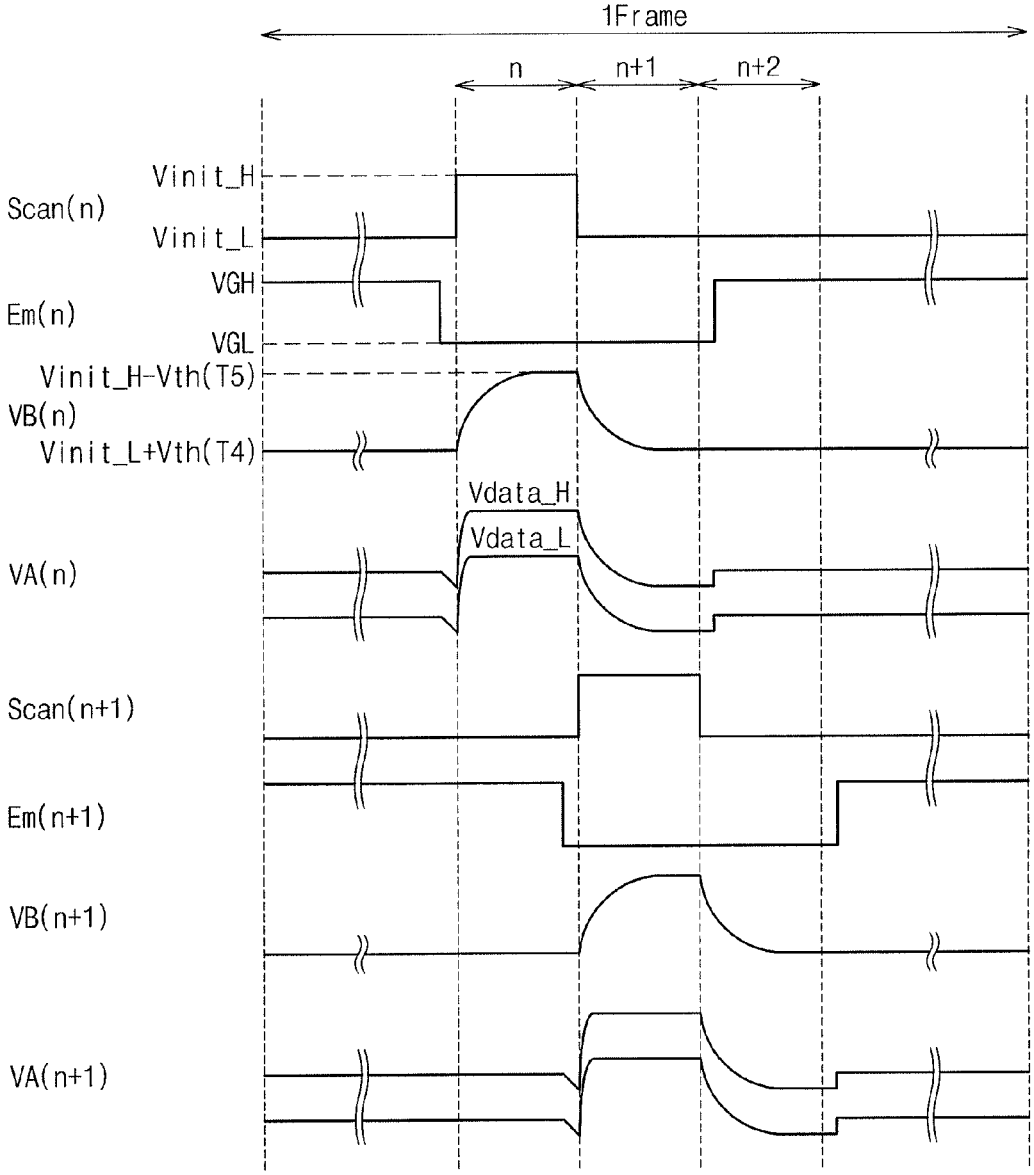
FIG. 2 illustrates an example of control signals for the display circuit.
Figure 3A:
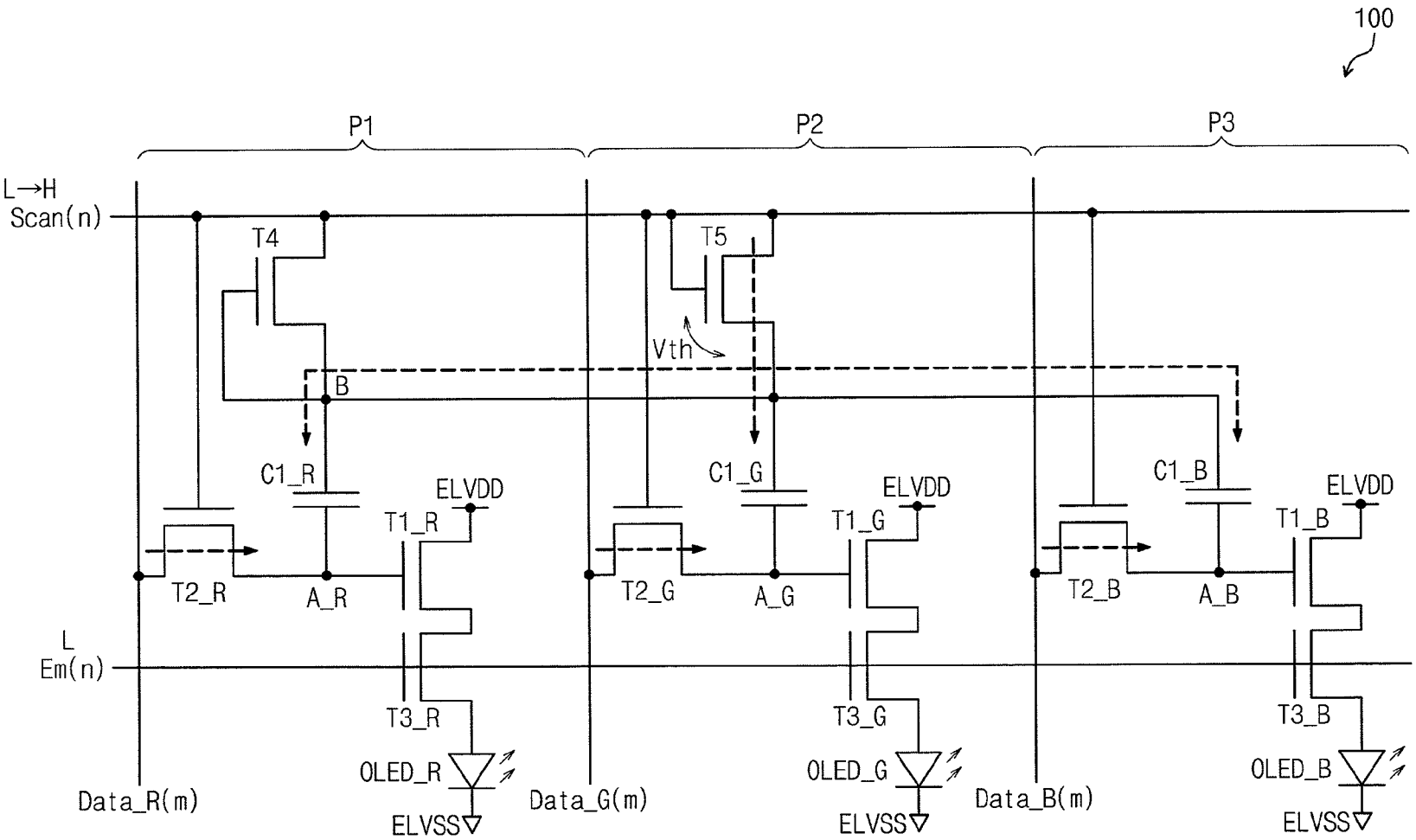
FIG. 3A illustrates an example of initialization and data writing operations.

FIG. 2 is a timing diagram illustrating an example of control signals for the display circuit 100. FIG. 3A explains an example of initialization and data writing operations, FIG. 3B explains an example of a compensation operation, and FIG. 3C explains an example of a light emission operation of the display circuit 100.

In FIG. 2, the symbol VB denotes the voltage of the common node B. The symbol VA in FIG. 2 denotes the voltage of a node A_R, A_G or A_B in FIGS. 3A to 3C. In the following, the nodes A_R, A_G and A_B may also be represented by a node A.

Referring to FIGS. 2 and 3A, when a scan signal provided to the display circuit 100 through the scan line Scan(n) changes from a low-level signal Vint_L to a high-level signal Vinit_H, the initialization transistor T5 is turned on. As a result, the voltage VB of the common node B rises from "Vinit_L+Vth(T4)" to "Vinit_H−Vth(T5)" by the signal Vinit_H.

The symbol "Vth(T4)" denotes the threshold voltage of the compensation transistor T4. The symbol "Vth(T5)" denotes the threshold voltage of the initialization transistor T5. The "Vinit_H−Vth(T5)" corresponds to certain potential of the common node B initialized by the initialization transistor T5. By changing the voltage VB of the common node B, the initialization operation of the display circuit 100 is performed.

Also, when a scan signal changes from the signal Vinit_L to the signal Vinit_H, the sampling transistor T2 is turned on and a data signal Vdata (or data voltage) is applied to the gate of the driving transistor T1 through the data line Data(m). The voltage VA of the node A rises according to the data signal Vdata and the capacitive element C1 having an end connected to the node A maintains the data signal Vdata. Since the capacitive element C1 maintains the data signal Vdata, a data writing operation is performed.

Figure 3B:
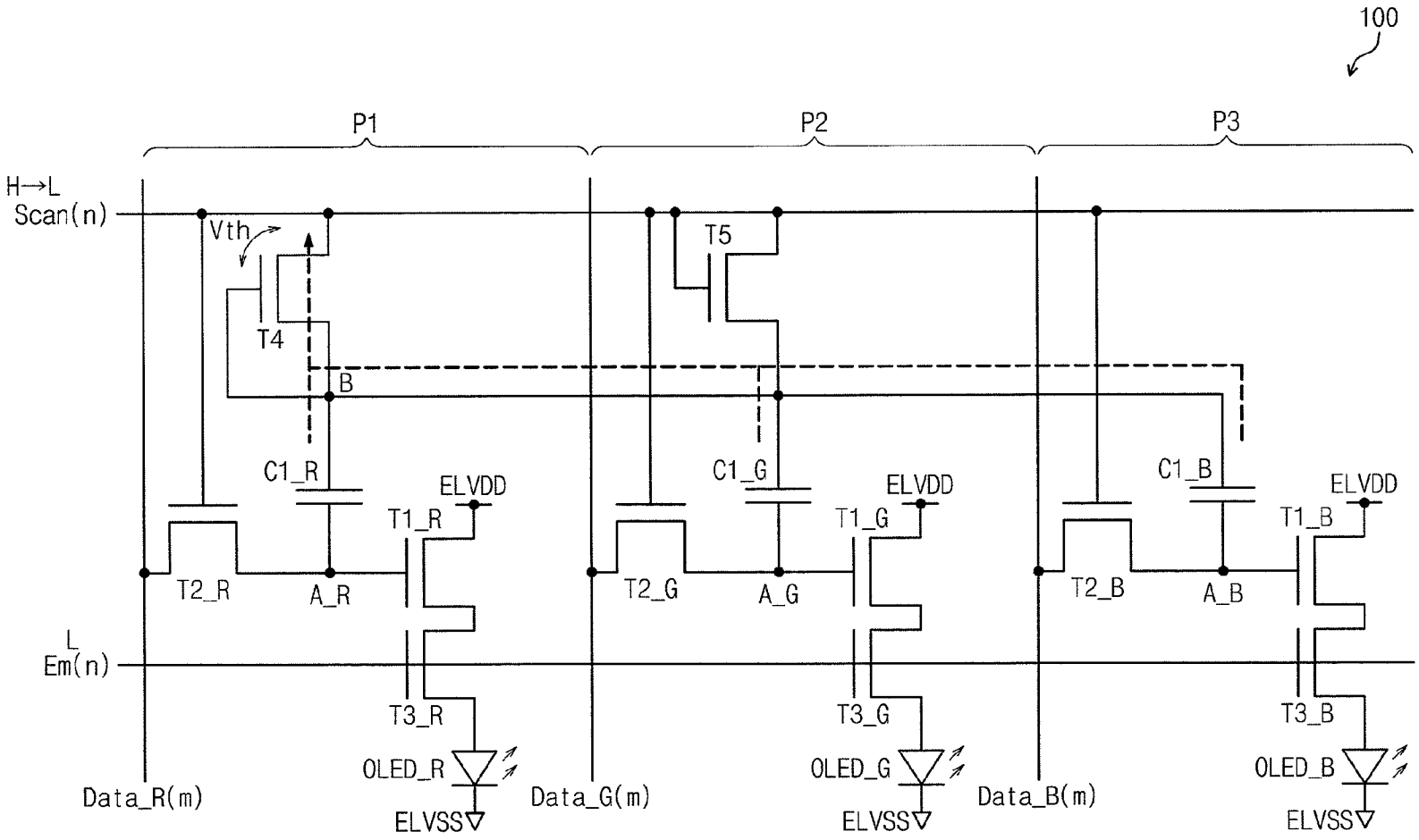
FIG. 3B illustrates an example of a compensation operation.

Referring to FIGS. 2 and 3B, when a scan signal provided to the display circuit 100 through the scan line Scan(n)

changes from the signal Vint_H to the signal Vinit_L, the initialization transistor T5 is turned off. As a result, the voltage VB of the common node B falls from "Vinit_H−Vth(T5)" to "Vinit_L+Vth(T4)". When the voltage VB of the common node B decreases, the voltage VA of the node A changes by the same amount as a change in the voltage of the common node B, e.g., the voltage VA of the node A becomes "Vdata+{(Vinit_L+Vth(T4))−(Vinit_H−Vth(T5))}." Since the voltage VA of node A changes as described above, the compensation operation of the threshold voltage of the driving transistor T1 is performed.

The compensation operation of the threshold voltage of the driving transistor T1 in FIG. 3B may be performed separately from the data writing operation in FIG. 3A, e.g., solely. Thus, in one embodiment, the display circuit 100 may sufficiently secure a time to perform the compensation operation of the threshold voltage of the driving transistor T1. For example, the time to perform the compensation operation of the threshold voltage of the driving transistor T1 may be sufficiently secured. Since the compensation operation of the threshold voltage of the driving transistor T1 may be sufficiently performed, display non-uniformity may be reduced or prevented when an image according to a data signal is displayed on a screen.

Figure 3C:
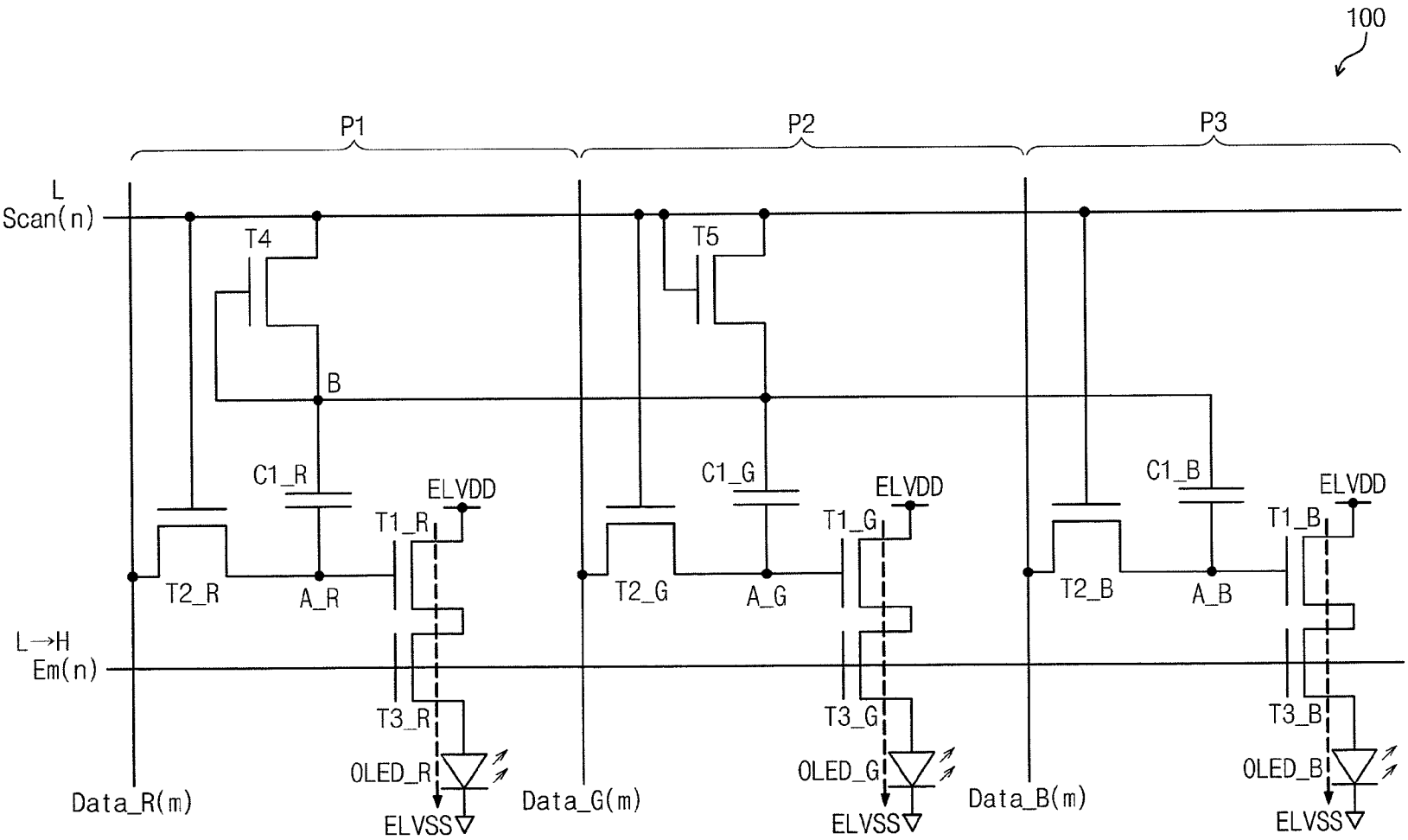
FIG. 3C illustrates an example for explaining a light emission operation of a display circuit.

Referring to FIGS. 2 and 3C, when a light emission control signal provided to the display circuit 100 through the light emitting control line Em(n) changes from a low-level signal VGL to a high-level signal VGH, the light emission control transistor T3 is turned on. When the voltage VA of the node A is sufficiently higher than the threshold voltage of the driving transistor T1, current according the voltage VA of the node A flows in the light emitting element OLED and the OLED emits light.

When the light emitting element OLED emits the light, the voltage Vgs between the gate and source of the driving transistor T1 is "Vdata+{(Vinit_L+Vth(T4))−(Vinit_H−Vth(T5))}−Voled." The voltage Voled is the voltage of the anode side of the light emitting element OLED in FIG. 3C, e.g., voltage of the source terminal of the driving transistor T1 in FIG. 3C.

The voltage Vgs corresponds to a current that is based on the threshold voltage Vth(T4) of the compensation transistor T4 which flows into the light emitting element OLED. The voltage Vgs corresponds to a constant current based on a data signal which flows into the light emitting element OLED in each pixel circuit P, irrespective of a change in the threshold voltage Vth of the driving transistor T1 in each pixel circuit P when the threshold voltage Vth(T4) of the compensation transistor T4 is equal to the threshold voltage Vth of the driving transistor T1.

As described above, the threshold voltage Vth(T4) of the compensation transistor T4 is the same (or approximately same) as the threshold voltage Vth of the driving transistor T1 when the compensation transistor T4 and the driving transistor T1 satisfy two or more of the following: same polarity, same size (e.g. one or both of channel width and channel length), same channel direction, and same oxide transistors.

Thus, the compensation operation of the threshold voltage of the driving transistor T1 is performed so that a current according to a data signal may be provided to the light emitting element OLED irrespective of a change in the threshold voltage Vth of the driving transistor T1. Additionally, or alternatively, a higher resolution image having reduced non-uniformity may be displayed on the screen.

Figure 4:
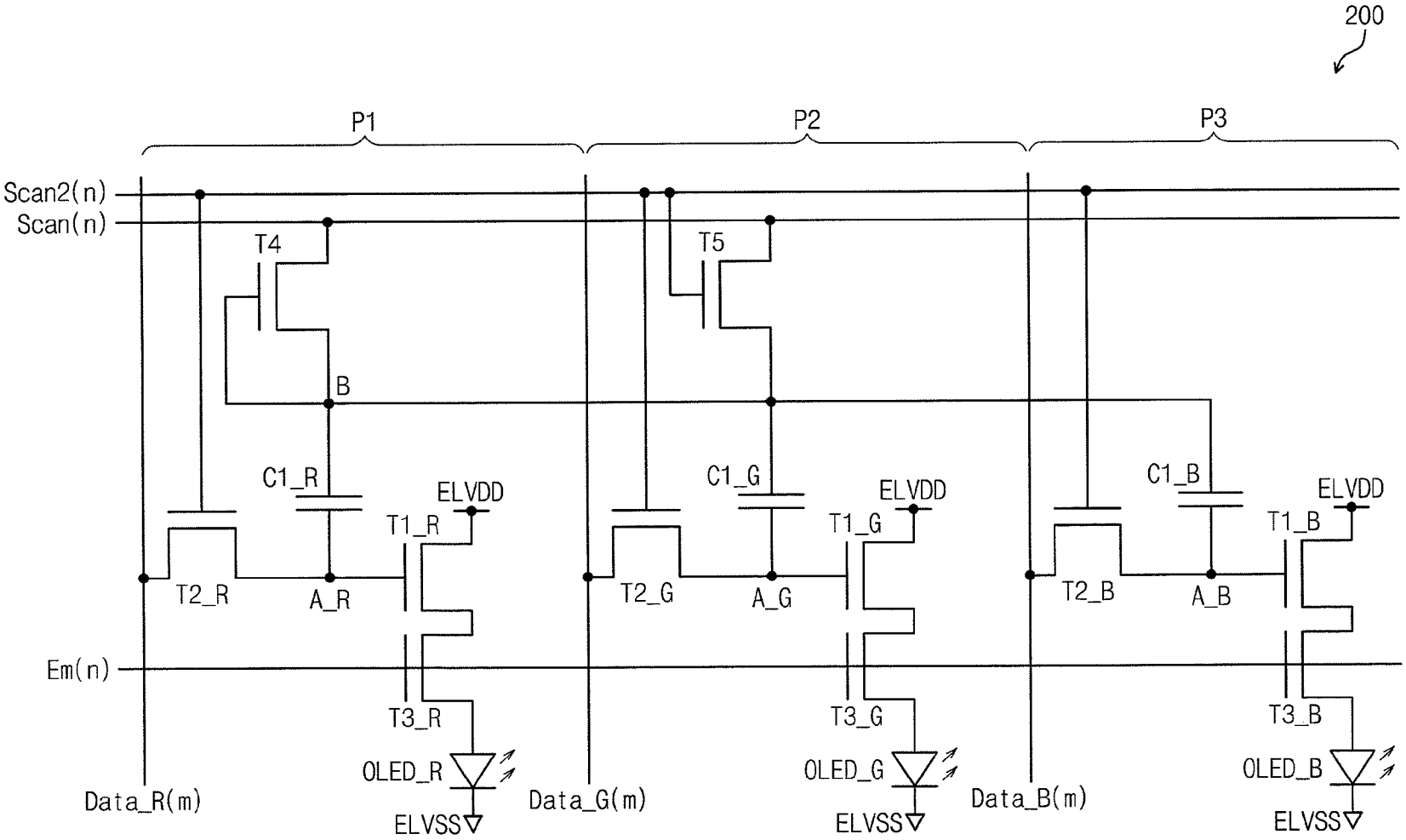
FIG. 4 illustrates another embodiment of a display circuit.
Figure 5:
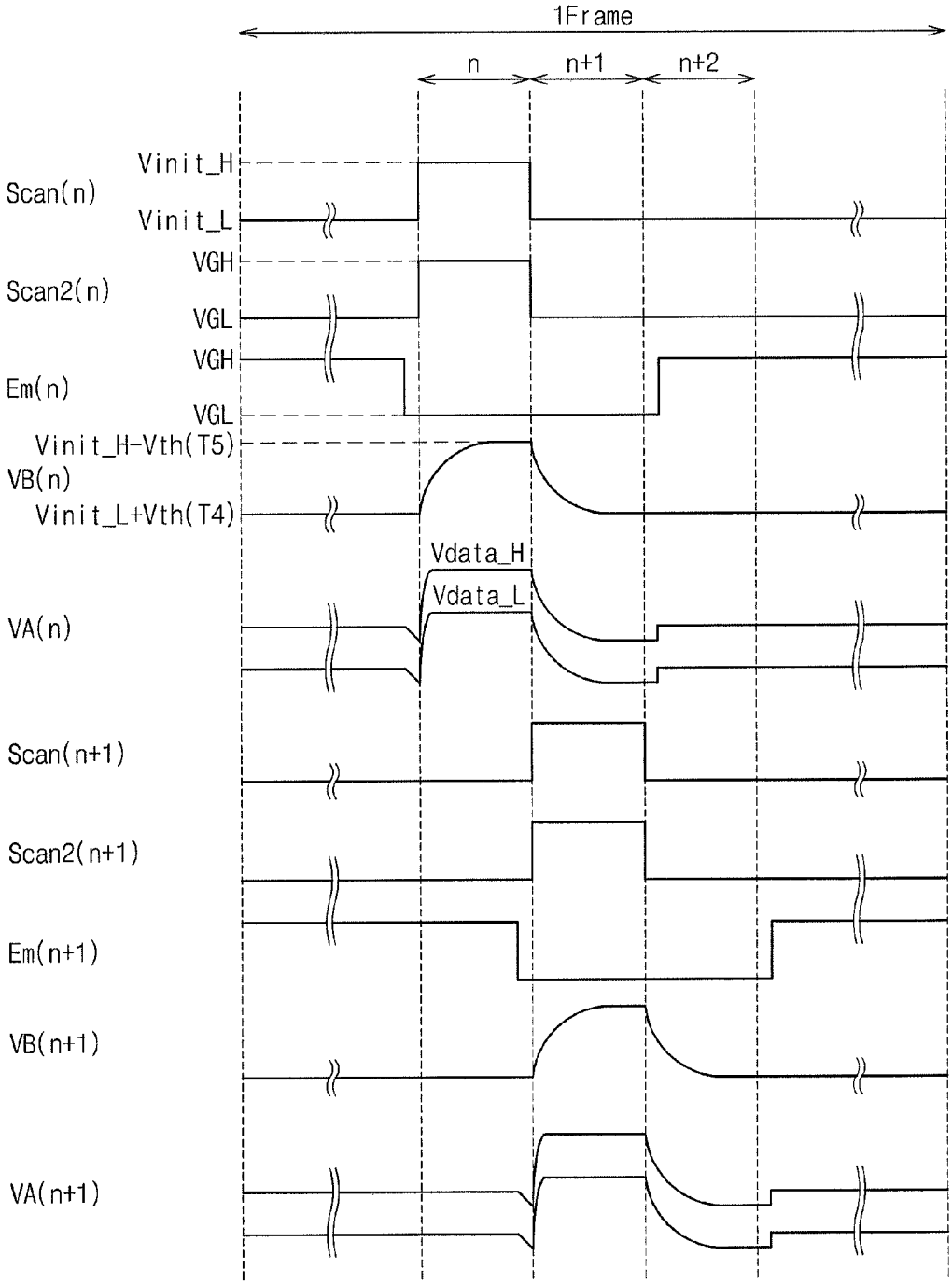
FIG. 5 illustrates an example of control signals for the display circuit in FIG. 4.

FIG. 4 illustrates another embodiment of a display circuit 200, and FIG. 5 illustrates an example of control signals for the display circuit 200. Referring to FIG. 4, the display circuit 200 the pixel circuits P1 to P3 are similar to the display circuit in FIG. 1 and the pixel circuits P1 to P3 share the compensation transistor T4. However, in the display circuit 200, the gate of the sampling transistor T2 and the gate of the initialization transistor T5 are connected to different scan lines, e.g., scan lines Scan2(*n*) and scan line Scan(n). The scan signal may be supplied from a scan driver to the scan line Scan2(*n*).

The scan signal supplied to the scan line Scan2(*n*) may have the same timing as the scan line supplied to the scan line Scan(n), as shown in FIG. 5. Also, in FIG. 5, the relationship between the signal level of the scan signal supplied to the scan line Scan(n) and the signal level of the scan signal supplied to the scan line Scan2(*n*) is "VGL<Vinit_L<Vinit_H<VGH". For example, the sampling transistor T2 of the display circuit 200 is turned on or off at the same timing as the sampling transistor T2 of the display circuit 100 in FIG. 1. Also, the initialization transistor T5 of the display circuit 200 is turned on or off at the same timing as the initialization transistor T5 of the display circuit 100 in FIG. 1.

Thus, operation of the display circuit 200 may be similar to that of the display circuit 100 described with reference to FIGS. 3A to 3C. As a result, the display circuit 200 may realize a similar effect as the display circuit 100.

As illustrated in FIG. 4, the display circuit 200 includes the scan line Scan2(*n*) supplying a scan signal applied to the gate of the initialization transistor T5, separately from the scan line Scan(n) connected to the compensation transistor T4. A low-level voltage VGL "VGL<Vinit_L" and a high-level voltage VGH "Vinit_H<VGH" is supplied to the scan line Scan2(*n*).

Thus, the display circuit 200 may completely turn on the initialization transistor T5 and when the initialization transistor T5 is turned on, the voltage of the common node B becomes Vinit_H. Also, when the light emitting element OLED in the display circuit 200 emits the light, the voltage Vgs between the gate and source of the driving transistor T1 is "Vdata+{(Vinit_L+Vth(T4))−Vinit_H}−Voled". Thus, the display circuit 200 may negate a change in the threshold voltage Vth(T5) of the initialization transistor T5.

In another embodiment, the display circuit 200 may have variations (e.g., different numbers of capacitors, transistors, etc.) as the display circuit 100 mentioned above. In one embodiment, the display circuit 200 may have a configuration in which only the gate of the initialization transistor T5 is connected to the scan line Scan2(*n*).

Although FIG. 5 represents an example where a voltage applied to the scan line Scan2(*n*) is different from that applied to the scan line Scan(n), the voltage applied to the scan line Scan2(*n*) and the voltage applied to the scan line Scan(n) may be the same. When the voltage applied to the scan line Scan2(*n*) and the voltage applied to the scan line Scan(n) may be the same, the display circuit 200 may have a similar effect as the display circuit 100.

Display circuits 100 and 200 may be included in a display apparatus for displaying an image corresponding to image data on a screen. In one embodiment, the display apparatus may include a data driver for supplying a data signal to a display unit, a scan driver for supplying a scan signal to the display unit, and a light emission control driver for supplying a light emission control signal to the display unit.

In one embodiment, the display apparatus may include a timing controller that controls the processing timing of each driver. In another embodiment, each driver or the timing controller may be an external device of the display apparatus.

The display circuits 100 and 200 may be applied to many types of devices, including but not limited to televisions, tablet-type devices, communication devices (e.g., mobile phones, smart phones, etc.), video/music players (or video/music recorders and players), game consoles, and computers (e.g., personal computers).

By way of summation and review, in an attempt to improve display quality, each pixel circuit in a display may include a transistor to compensate for variations in the threshold voltage of the driving transistor. The presence of the compensation transistor increases the size of the pixel circuits and also increases the data writing time, because compensation is performed in the data writing (or data programming) period.

In accordance with one or more of the aforementioned embodiments, two or more pixel circuits share a same compensation transistor. The compensation operation performed by the compensation transistor may be performed in a period different from a data writing operation. Thus, the time for write data may be reduced and also the number of transistors in the display circuit may be reduced.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display circuit, comprising:

a plurality of pixel circuits, each pixel circuit including a driving transistor to control light emission of a light emitter;

an initialization transistor coupled to a common node of the pixel circuits, the initialization transistor to initialize the common node; and a compensation transistor coupled to the common node, the compensation transistor to compensate threshold voltages of the driving transistors of the pixel circuits, wherein the pixel circuits share the initialization transistor and the compensation transistor, and wherein the initialization transistor and the compensation transistor are coupled in parallel between the common node and a scan line.

2. The display circuit as claimed in claim 1, wherein:

each of the pixel circuits includes a capacitive element, the driving transistor includes a first terminal connected to a power supply, a second terminal connected to a first terminal of the light emitter, and a control terminal, the driving transistor to connect the power supply and the first terminal of the 1 emitter based on a voltage applied to the control terminal to enable the light emitter to selectively emit light, the capacitive element having a first end connected to the control terminal of the driving transistor and a second end connected to the common node of the pixel circuits, and one of a first or a second terminal of the compensation transistor is connected to the common node.

3. The display circuit as claimed in claim 2, wherein one of the pixel circuits includes the compensation transistor.

4. The display circuit as claimed in claim 3, wherein the compensation transistor and the driving transistor have a same polarity.

5. The display circuit as claimed in claim 4, wherein the compensation transistor and the driving transistor have substantially a same channel width and channel length.

6. The display circuit as claimed in claim 5, wherein the compensation transistor and the driving transistor have a same channel direction.

7. The display circuit as claimed in claim 6, wherein the compensation transistor and the driving transistor are oxide transistors.

8. The display circuit as claimed in claim 7, wherein the initialization transistor initializes a potential of the common node to allow the common node to have certain potential.

9. The display circuit as claimed in claim 8, wherein one of a first or a second terminal of the initialization transistor is connected to the common node.

10. The display circuit as claimed in claim 9, wherein another one of the pixel circuits includes the initialization transistor.

11. The display circuit as claimed in claim 9, wherein the pixel circuit including the compensation transistor includes the initialization transistor.

12. A display apparatus, comprising:

a display circuit including a plurality of pixel circuits, each pixel circuit including a driving transistor to control light emission of a light emitter, an initialization transistor coupled to a common node of the pixel circuits, and a compensation transistor coupled to the common node, the initialization transistor to initialize the common node, the compensation transistor to compensate threshold voltages of the driving transistors of the pixel circuits, wherein the pixel circuits share the initialization transistor and the compensation transistor, and wherein the initialization transistor and the compensation transistor are coupled in parallel between the common node and a scan line.

13. A circuit, comprising:

a first pixel circuit;

a second pixel circuit;

a first transistor coupled to a common node of the first and second pixel circuits, the first transistor to initialize the common node; and a second transistor coupled to the common node, the second transistor to compensate threshold voltages of driving transistors in the first pixel circuit and the second pixel circuit, wherein the first transistor and the second transistor are shared by the first and second pixel circuits, and wherein the first and second transistors are coupled in parallel between the common node and a first scan line.

14. The circuit as claimed in claim 13, wherein the first pixel circuit includes the second transistor.

15. The circuit as claimed in claim 13, wherein the first pixel circuit is coupled to the second transistor.

16. The circuit as claimed in claim 13, wherein the second transistor and the driving transistor of the first and second pixel circuits have at least two of a same polarity, substantially a same size, a same channel direction, or are oxide transistors.

17. The circuit as claimed in claim 16, wherein the size includes channel width and channel length.

18. The circuit as claimed in claim 13, wherein:

the first and second pixel circuits are connected to a second scan line, and the second transistor is connected to the first scan line different from the second scan line.

19. The circuit as claimed in claim 3, wherein the first transistor and the second transistor are to output signals along a same signal line.

20. The display circuit as claimed in claim 1, wherein the initialization transistor and the compensation transistor are diode-connected.

* * * * *